US010969183B2

(12) United States Patent
Gibbens et al.

(10) Patent No.: US 10,969,183 B2
(45) Date of Patent: Apr. 6, 2021

(54) CONFIGURABLE BLOWBACK BOLT SYSTEM

(71) Applicants: Kevin W. Gibbens, Mesa, AZ (US); David W. Gibbens, Mesa, AZ (US)

(72) Inventors: Kevin W. Gibbens, Mesa, AZ (US); David W. Gibbens, Mesa, AZ (US)

(73) Assignee: Gibbens Engineering Group, LLC, Mesa, AZ (US)

( * ) Notice: Subject to any disclaimer, the term of this patent is extended or adjusted under 35 U.S.C. 154(b) by 0 days.

(21) Appl. No.: 16/292,034

(22) Filed: Mar. 4, 2019

(65) Prior Publication Data

US 2019/0271515 A1 Sep. 5, 2019

Related U.S. Application Data

(60) Provisional application No. 62/637,461, filed on Mar. 2, 2018.

(51) Int. Cl.

| | |
|---|---|
| ***F41A 3/26*** | (2006.01) |
| ***F41A 19/13*** | (2006.01) |
| ***F41A 15/14*** | (2006.01) |

(52) U.S. Cl.

CPC ..... *F41A 3/26* (2013.01); *F41A 15/14* (2013.01); *F41A 19/13* (2013.01)

(58) Field of Classification Search

CPC ..... F41A 3/26; F41A 3/78; F41A 3/80; F41A 3/82; F41A 3/84; F41A 3/64; F41A 3/66; F41A 11/00; F41A 11/02; F41A 99/00; F41A 35/06; F41A 19/13; F41A 15/14

USPC ..... 89/194, 197

See application file for complete search history.

(56) References Cited

U.S. PATENT DOCUMENTS

| | | | | |
|---|---|---|---|---|
| 3,670,442 | A * | 6/1972 | Kennedy | F41A 19/45 42/70.08 |
| 3,771,415 | A * | 11/1973 | Into | F41A 3/78 89/16 |
| 4,658,702 | A * | 4/1987 | Tatro | F41A 19/45 42/16 |
| 5,499,569 | A * | 3/1996 | Schuetz | F41A 3/54 42/25 |
| 5,900,577 | A * | 5/1999 | Robinson | F41A 11/02 89/156 |
| 6,625,916 | B1 * | 9/2003 | Dionne | F41A 3/54 102/444 |
| 6,966,137 | B2 * | 11/2005 | Gussalli Beretta | F41A 15/14 42/16 |
| 7,316,091 | B1 * | 1/2008 | Desomma | F41A 3/26 42/16 |
| 7,395,626 | B2 * | 7/2008 | Zedrosser | F41A 15/14 42/25 |

(Continued)

*Primary Examiner* — Jonathan C Weber

(74) *Attorney, Agent, or Firm* — Schmeisen, Olsen & Watts LLP

(57) ABSTRACT

A configurable blowback bolt system is provided. Embodiments include a two-part configurable bolt assembly having a bolt carrier and a configurable bolt that allows for use with various calibers of ammunition, both rifle and pistol. The configurable bolt may also eject cartridges to the right or left side of the rifle by moving the extractor to one or the other side of the bolt. A buffer may be included as part of the configurable blowback bolt to shorten the stroke based on the caliber of ammunition being fired with the configurable blowback bolt system.

11 Claims, 8 Drawing Sheets

(56) References Cited

U.S. PATENT DOCUMENTS

| | | | | |
|---|---|---|---|---|
| 7,886,470 | B1 * | 2/2011 | Doiron | F41A 3/46 42/16 |
| 8,806,789 | B2 * | 8/2014 | Devine | F41A 3/26 42/16 |
| 9,459,060 | B2 * | 10/2016 | Langevin | F41A 3/66 |
| 9,625,232 | B2 * | 4/2017 | Gomez | F41A 3/84 |
| 2006/0070288 | A1 * | 4/2006 | Zedrosser | F41A 15/14 42/25 |
| 2013/0139424 | A1 * | 6/2013 | Devine | F41C 23/22 42/16 |
| 2014/0075807 | A1 * | 3/2014 | Lewis | F41A 15/14 42/25 |
| 2014/0224114 | A1 * | 8/2014 | Faxon | F41A 3/66 89/193 |

* cited by examiner

CONFIGURABLE BLOWBACK BOLT SYSTEM

CROSS REFERENCE TO RELATED APPLICATION[S]

This application claims priority to U.S. Provisional patent application entitled "CONFIGURABLE BLOW BACK BOLT," Ser. No. 62/637,461, filed Mar. 2, 2018, the disclosure of which is hereby incorporated entirely herein by reference.

BACKGROUND OF THE INVENTION

Technical Field

This invention relates generally to a firearm blowback bolt system, and more particularly to a configurable blowback bolt system.

State of the Art

AR-style rifles that use a blowback bolt are usually used to fire pistol-caliber cartridges in the platform that was originally designed to fire rifle cartridges. These AR-style rifles can be converted from firing rifle cartridges to pistol cartridges, or they can be used with AR-style rifles designed from the beginning to be blowback systems to fire mainly pistol-caliber cartridges. This is generally done by changing out the entire rifle-caliber bolt assembly for a bolt assembly that can handle pistol-caliber cartridges.

What is needed is a configurable blowback bolt system with a modular design that can be configured for use with both pistol and rifle cartridges of different calibers.

SUMMARY OF THE INVENTION

The present invention relates to a configurable blowback bolt system. Generally, the configurable blowback bolt system includes a bolt carrier, a configurable bolt, and a buffer, wherein the configurable bolt can be configured to fire rifle- or pistol-cartridges, of different calibers, and can be configured to eject the cartridges on a right or left side of the firearm.

The bolt assembly of the present invention comprises two main parts, the bolt and the bolt carrier. The bolt carrier is an elongated member having a front portion and a rear portion. The front portion comprises an opening, for receiving the bolt therein. When assembled, a boss of the bolt extends through a slot in the top of the bolt carrier, thereby maintaining the orientation of the bolt within the opening of the bolt carrier. The bolt carrier gives the bolt assembly its overall length to allow it to operate in an AR platform and provides the necessary mass to allow the blowback system to operate safely and as intended.

The novel modular design of the bolt assembly of the present invention allows the bolt to be easily interchanged with other bolts of different calibers to accommodate cartridges of other calibers. Changing the caliber of the bolt assembly is a simple matter of interchanging the bolt with a bolt of another caliber.

The configurable blowback bolt system of the present invention may also comprise a buffer inserted into a buffer tube of the firearm directly behind the rear end of the bolt carrier. Various combinations of different masses and lengths of the buffer, in conjunction with various masses and configurations of interchangeable bolts, as described above, may be selected, interchangeably, to accommodate firing of different calibers of cartridges, as well as either long-stroke or short-stroke blowback operation of the firearm, as appropriate for different cartridge lengths.

The two-part bolt assembly of the present invention is easier to manufacture than conventional bolt assemblies. For example, conventional bolt assemblies require the firing pin through hole to be bored through the entire length of the bolt carrier. In contrast, the firing pin hole of the bolt of the present invention need only be bored through the bolt portion and not through the rear portion of the bolt carrier. The two-part assembly also allows for manufacture of a single bolt carrier that can accommodate multiple calibers by choosing the correct bolt for the desired caliber, in a modular fashion.

Another novel feature of a configurable blowback bolt system of the present invention is that the cup of the bolt is configured to retain an extractor on either side of the cup. The bolt has two extractor recesses, one extractor recess being on one side of the cup and the second extractor recess being on the other side of the cup. Interchangeability of the extractor and extractor spring enables the configurable blowback bolt system to be used for ejection of spent cartridges either to the right side or to the left side of the firearm, interchangeably. The bolt further comprises a pair of longitudinal ejector grooves, each longitudinal ejector groove thereof being disposed directly opposite one of the extractor recesses, respectively, for accommodating a static ejector of the receiver of the firearm, either on the right side of the firearm or on the left side of the firearm, interchangeably. The bolt, having two longitudinal ejector grooves, one on each side, and two extractor recesses, one on each side, may be configured for ejecting spent cartridges either to the right side or to the left side of a firearm, interchangeably.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

A configurable blowback bolt system comprises a configurable blowback bolt assembly and buffer for AR-style firearms that can be easily configured to eject spent cartridges either to the right side or to the left side and to accommodate cartridges of different calibers, including pistol calibers and rifle calibers. The buffer, along with a feature on the bolt, allows the system to be easily configured for use with long-stroke or short-stroke firearms AR-style rifles that use a blowback bolt are commonly used to fire pistol-caliber cartridges in the platform that was originally designed to fire rifle cartridges. These AR-style rifles can be converted from firing rifle cartridges to pistol cartridges, or they can be used with AR-style rifles designed from the beginning to be a blowback system to fire mainly pistol-caliber cartridges. This is generally done by changing out the entire bolt assembly for one that can handle pistol caliber cartridges.

Figure 1:
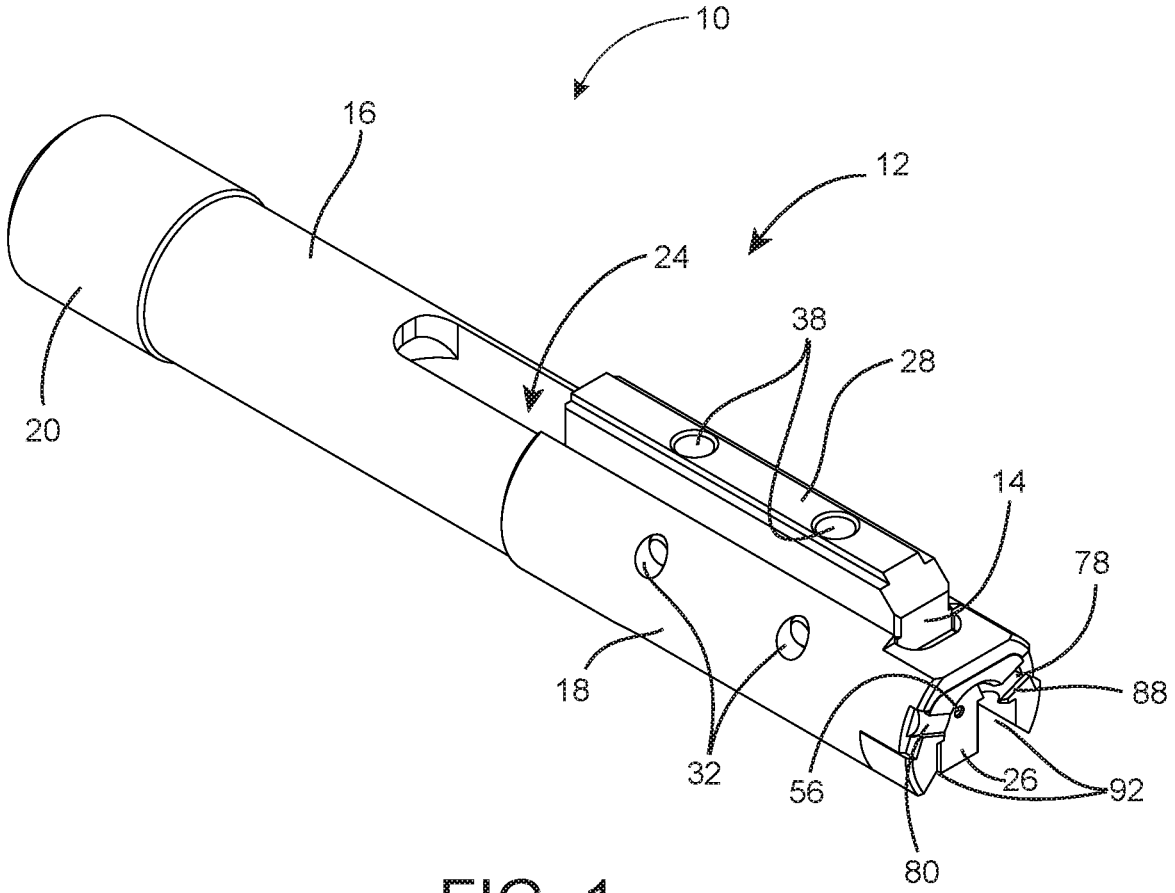
FIG. 1 is a perspective view of a configurable bolt assembly of a configurable blowback bolt system, according to embodiments.
Figure 2:
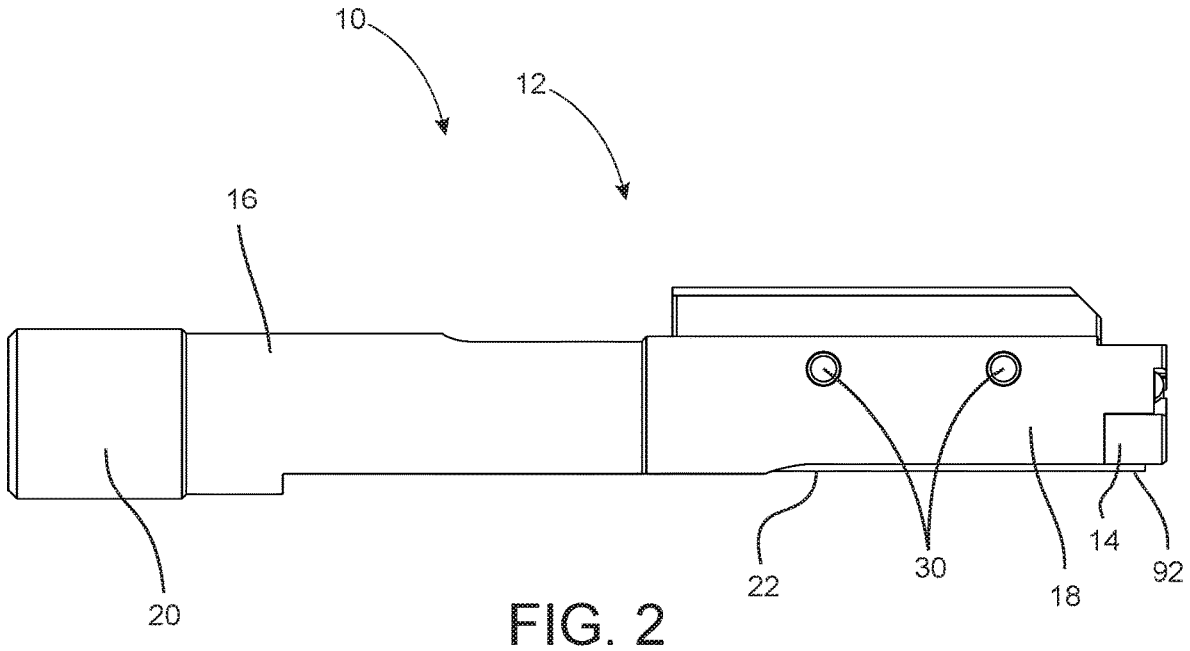
FIG. 2 is a side view of a configurable bolt assembly of a configurable blowback bolt system, according to embodiments.
Figure 3:
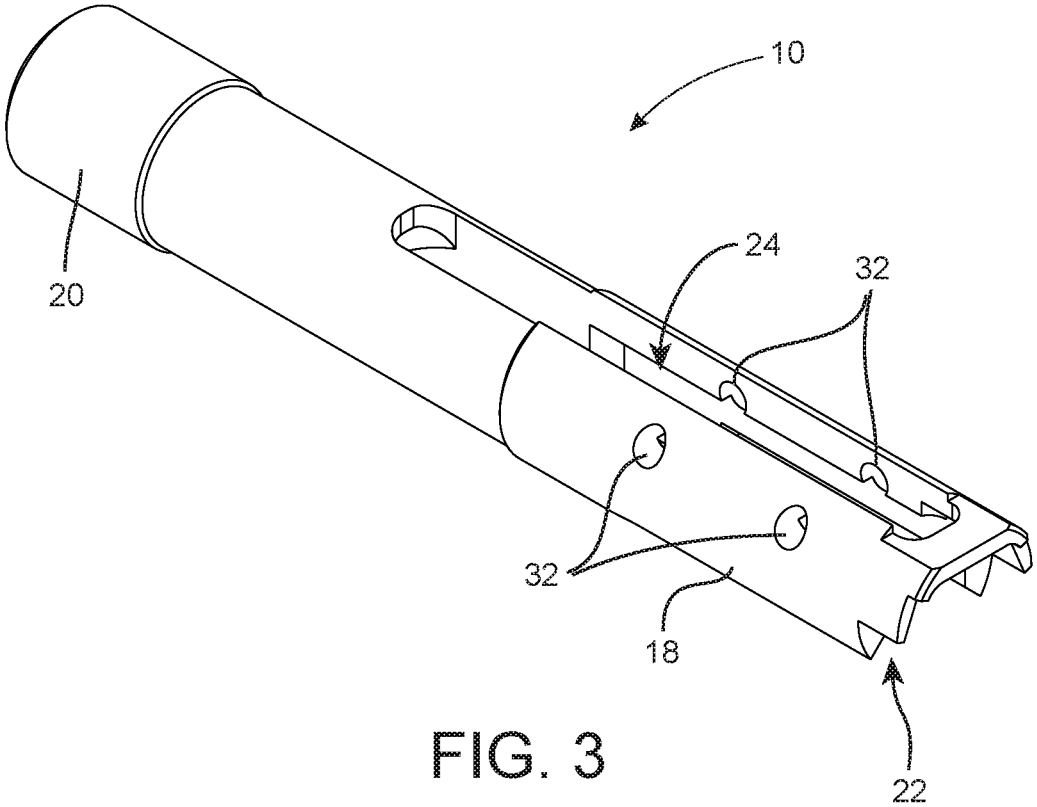
FIG. 3 is a perspective view of bolt carrier of a configurable bolt assembly, according to embodiments.

Referring to the drawings, as shown in FIGS. 1-7, the bolt assembly 12 of the present invention comprises two main parts, the bolt 14 and the bolt carrier 16, which are both symmetrical with respect to a vertical plane extending along the longitudinal axis of the bolt assembly 12. The bolt carrier 16 is an elongated member having a front portion 18 and a rear portion 20. The front portion 18 comprises an opening 22, for receiving the bolt 14 therein, and a longitudinal slot 24 through the top thereof. The bolt 14 has a substantially cylindrical body with a cup 26 at the front thereof and a longitudinal boss 28 extending upward therefrom along the top thereof. When assembled, the boss 28 extends through the slot 24 in the top of the bolt carrier 16, as shown in FIG. 1, thereby maintaining the orientation of the bolt 14 within the opening of the bolt carrier 16. The bolt carrier 16 gives the bolt assembly 12 its overall length to allow it to operate in an AR platform and provides the necessary mass to allow the blowback system 10 to operate safely and as intended.

Figure 4:
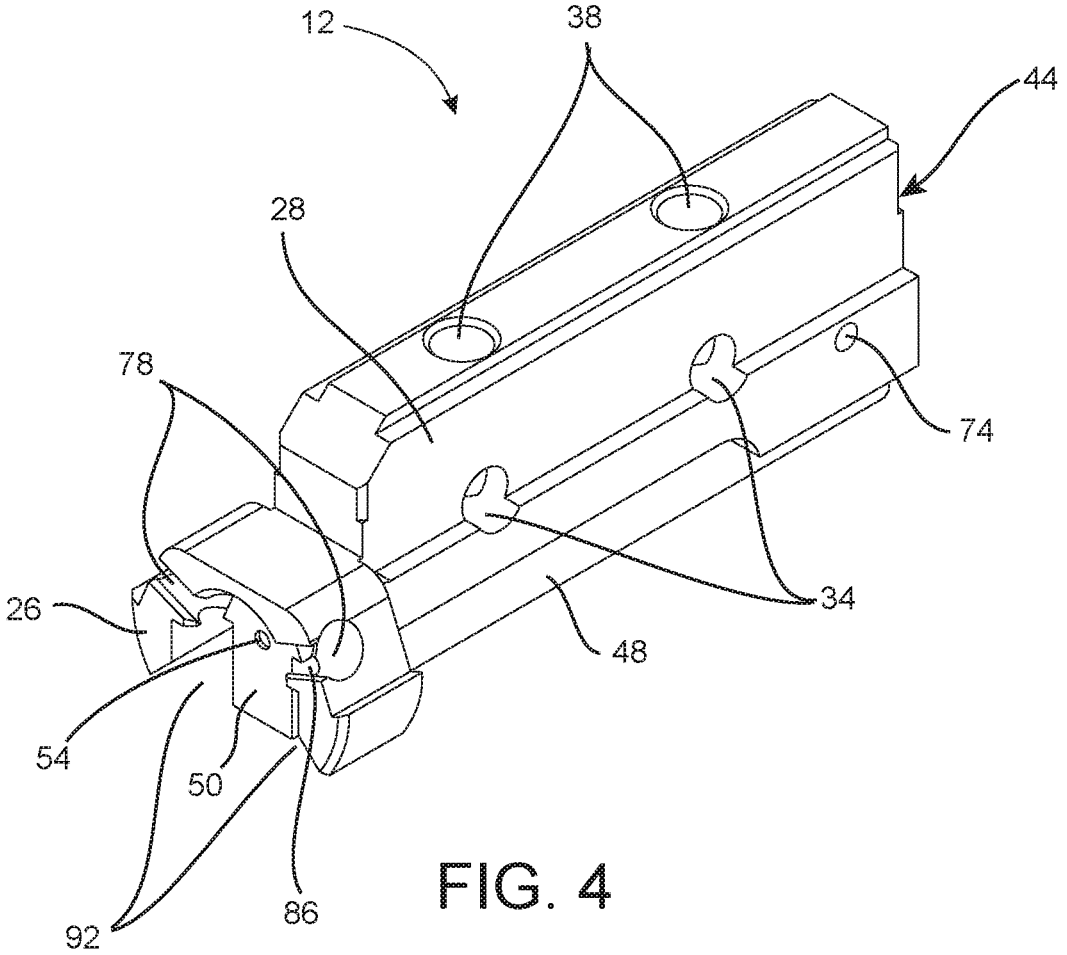
FIG. 4 is a perspective view of a configurable bolt of a configurable bolt assembly, according to embodiments.
Figure 5:
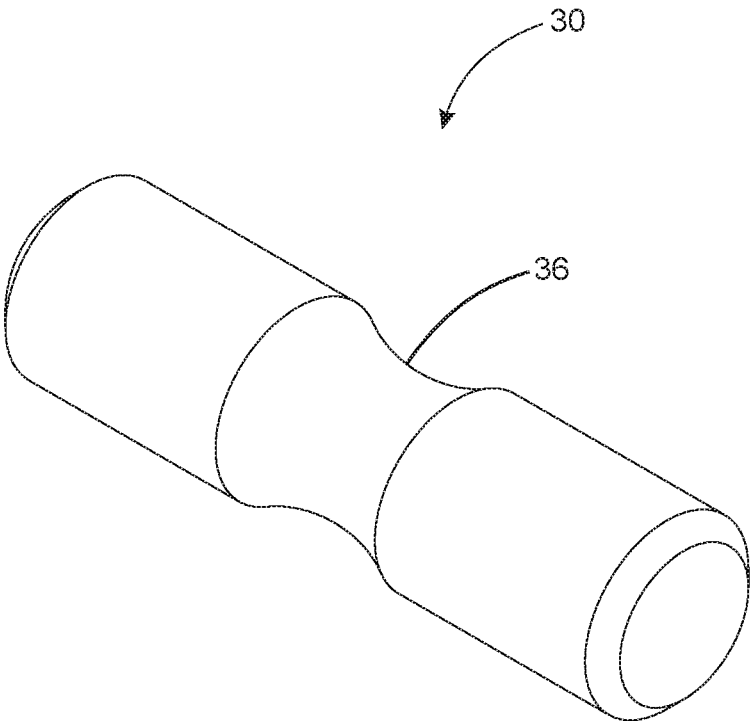
FIG. 5 is a perspective view of a connecting pin of a configurable bolt assembly, according to embodiments.
Figure 6:
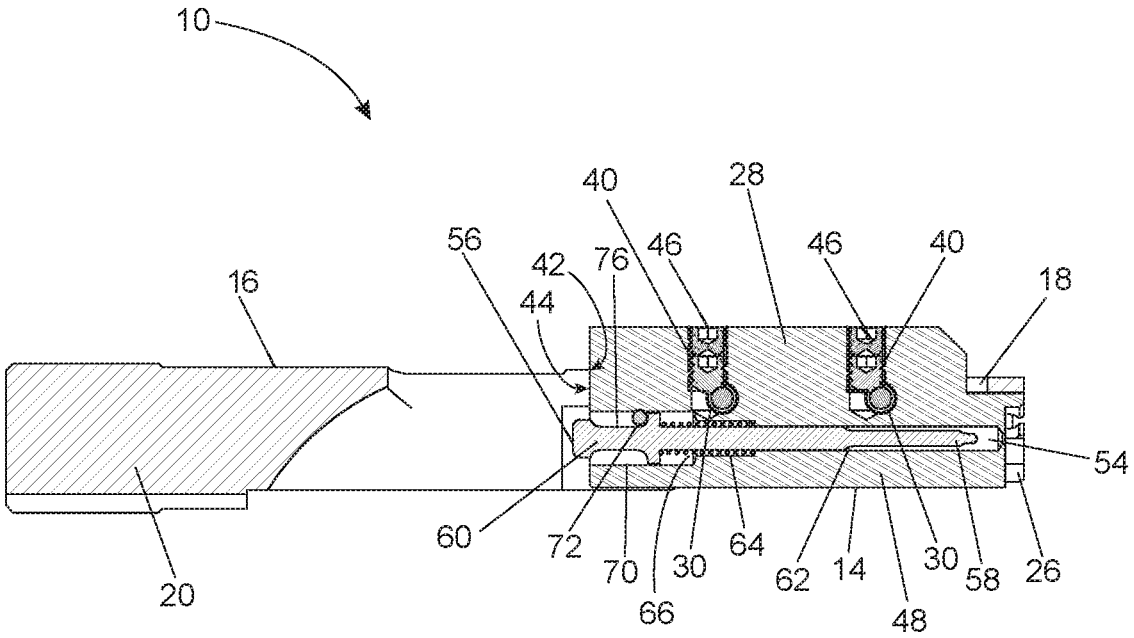
FIG. 6 is a section view of a configurable bolt assembly of a configurable blowback bolt system, according to embodiments.

Tolerances in the joints between corresponding surfaces of the bolt 14 and the bolt carrier 16 are intentionally large, to lower machining costs and to increase the ease of assembly. The large tolerances allow for some looseness between the bolt 14 and the bolt carrier 16 when assembled and prior to being tightly secured. The bolt 14 and bolt carrier 16 are held securely together by a pair of connecting pins 30 that are inserted laterally through the bolt carrier 16 and the bolt 14. The bolt carrier 16 and the bolt 14 have lateral apertures, 32 and 34, respectively, therethrough for receiving the connecting pins 30. The lateral apertures 32 through the bolt carrier 16 are machined close to the diameter of the connecting pins 30. The lateral apertures 34 through the bolt 14 are machined to a slightly larger diameter. Each of the pair of connecting pins 30 comprises a groove 36 around the middle thereof, as shown in FIG. 5. A pair of threaded apertures 38 extend downward through the boss 28 of the bolt 14 and into the lateral apertures 34 thereof, as shown in FIGS. 1 and 4. As shown in FIG. 6, each of the threaded apertures 38 is offset slightly to the rear of each lateral aperture 34, respectively. Each threaded aperture 38 receives a cone point set screw 40, that is threaded thereinto and bears on the groove 36 of the connecting pin 30. Contact of the cone point set screw 40 with the groove 36 of the connecting pin 30 tends to push the connecting pin 30, and, therefore, the bolt carrier 16 forward, while pushing the cone point set screw 40, and, therefore, the bolt 14 backward, upon tightening of the cone point set screw 40. The bolt carrier 16 has a bearing surface 42 that bears on the back surface 44 of the bolt 14. Any looseness in the joint between the bolt carrier bearing surface 42 and the back surface 44 of the bolt 14 is taken out by tightening each of the pair of cone point set screws 40, such that the bolt 14 is held tightly and firmly against the bolt carrier 16. Each of a pair of cub point set screws 46 is also threaded into the threaded apertures 38, respectively, and tightened against the cone point set screws 40 to prevent the cone point set screws 40 from loosening. The grooves 36 around the connecting pins 30 also locate the pins 30 within the bolt 14 and in contact with the cone point set screws 40, and prevent the connecting pins 30 from working out of the lateral apertures 34 over time.

To remove and exchange the bolt 14 for a bolt 14 of a different caliber, the two cub point set screws 46 are removed, and the two cone point set screws 40 are loosened just enough to clear the grooves 36 of the connecting pins 30 to remove the two connecting pins 30. With the connecting pins 30 removed, the bolt 14 will drop downward and out of the opening 22 of the bolt carrier 16. A bolt 14 of a different caliber is then inserted up through the opening 22, the connecting pins 30 reinserted, and the set screws, 40 and 46, tightened again.

As shown in FIG. 4, the bolt 14 further comprises a lug 48 that extends downward therefrom, having a forward-facing surface 50 that pushes a new cartridge out of the magazine of the firearm for loading into the chamber. The cup 26 on the front end of the bolt 14 is also forward facing and configured for receiving the back portion of the cartridge and helping to locate the cartridge into the chamber. The cup 26 has the lower portion removed to accommodate the cartridge sliding up into position when loading.

The size and shape of the cup 26 determines what cartridge caliber the bolt 14 is compatible with. The novel modular design of the bolt assembly 12 of the present invention allows the bolt 14 to be easily interchanged with other bolts 14 of different calibers to accommodate cartridges of other calibers. Bolts 14 of different calibers also have different masses that are tuned to properly dissipate recoil forces when firing the weapon. They may also have different lengths to allow the hammer to be properly cocked when used with longer or shorter stroke systems to accommodate different lengths of cartridges. Pistol cartridges are generally shorter than rifle cartridges. Changing the caliber of the bolt assembly 12 is a simple matter of interchanging the bolt 14 with a bolt 14 of another caliber.

Figure 8:
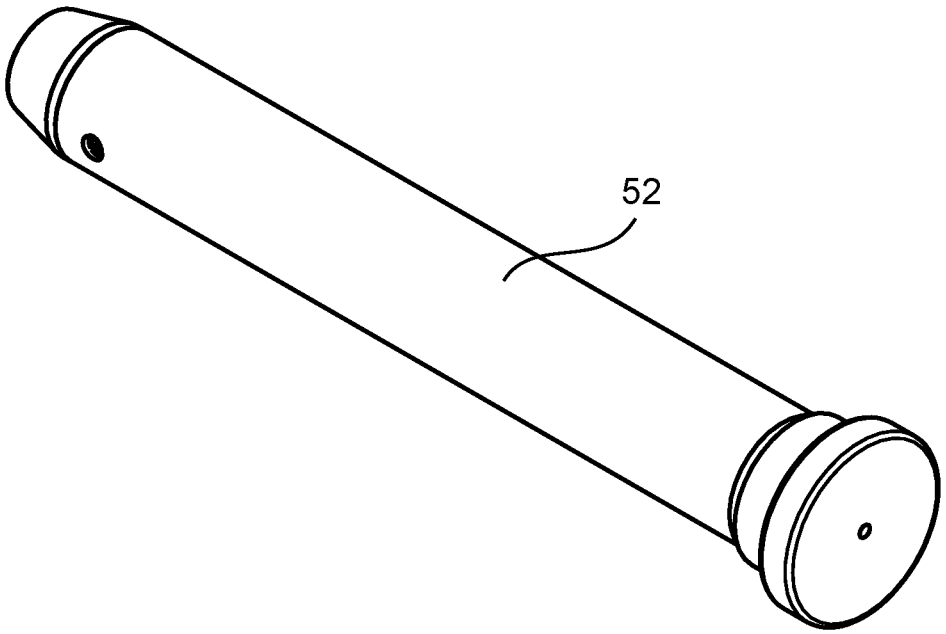
FIG. 8 is a perspective view of a buffer of a configurable blowback bolt system, according to embodiments.

The configurable blowback bolt system 10 of the present invention may also comprise a buffer 52, as shown in FIG. 8. The buffer 52 is inserted into a buffer tube of the firearm directly behind the rear portion 20 of the bolt carrier 16 (not shown). In operation, recoil forces in the bolt 14 are dissipated through the internal weights of the buffer, when the bolt carrier 16 impacts the buffer 52 upon firing of the firearm by a user, so as to minimize recoil forces felt by the user. Various combinations of different masses and lengths of interchangeable buffers 52, in conjunction with various masses and configurations of interchangeable bolts 14, as described above, may be selected, to accommodate firing of different calibers of cartridges, as well as either long-stroke or short-stroke blowback operation of the firearm, as appropriate for different cartridge lengths. The proper combination of mass and length of the interchangeable buffer 52, in conjunction with the mass and configuration of the interchangeable bolt 14, is necessary to minimize the recoil impact forces to the user while maintaining proper automatic blowback recharging functionality of the firearm.

The configurable blowback bolt system 10 of the present invention may therefore be used with either a short stroke or a long stroke system and with cartridges of different lengths and calibers. The modular design allows for interchangeability of the buffer 52 and the bolt 14, while using the same bolt carrier 16. As explained above, different combinations of masses and lengths of the buffer 52 and the bolt 14 allow for use with both short stroke and long stroke systems and for firing of cartridges of different calibers, including both rifle cartridges and pistol cartridges.

Figure 7:
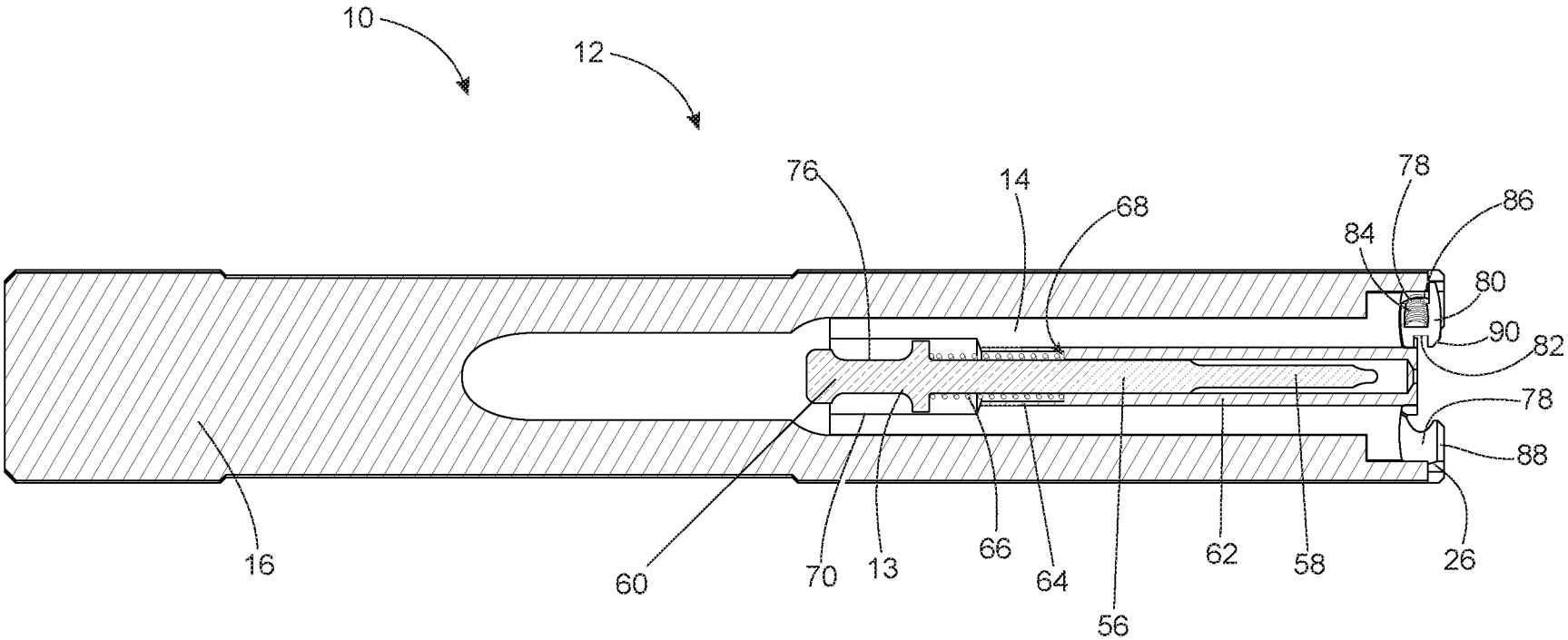
FIG. 7 is another section view of a configurable bolt assembly of a configurable blowback bolt system, according to embodiments.

As shown in FIGS. 6 and 7, a firing pin through hole 54 extends longitudinally through the center of the bolt 14 for receiving a firing pin 56. The firing pin 56 is an elongate member having a pointed tip 58 on the front end thereof and a head 60 on the back end thereof. The pin 56 is inserted into the through hole 54 from the back of the bolt 14. The through hole 54 steps down to successively smaller diameters. The smallest diameter 62 at the front of the bolt 14 receives the narrow, pointed tip 58 and front end of the firing pin 56. The middle portion 64 has a slightly larger diameter to accommodate a firing pin spring 66. The firing pin spring 66 is a coil spring that circumscribes the middle of the firing pin 56. It bears on the firing pin head 60 on the back end, and on the step 68 of the smallest diameter portion 62 of the through hole 54 on the front end. Finally, the back portion 70 of the through hole 54 has an even larger diameter for receiving the head 60 of the firing pin 56. The firing pin 56 is maintained in the through hole 54 by a firing pin retainer 72. The firing pin retainer 72 is inserted into a firing pin retainer aperture 74 through the bolt 14, such that the firing pin retainer 72 rests within a radial groove 76 around the head 60 of the firing pin 56. The groove 76 around the head 60 of the firing pin 56 is large enough to allow some movement of the firing pin 56 longitudinally within the through hole 54. The firing pin spring 66 biases the firing pin 56 backward until stopped by the firing pin retainer 72. In operation, upon pulling the trigger of the firearm, the hammer impacts the head 60 of the firing pin 56 with enough force to overcome the spring 66 and force the pointed tip 58 of the firing pin 56 into the primer of the rim of a loaded cartridge to fire the weapon. The firing pin spring 66 then returns the firing pin 56 back again.

The two-part bolt assembly 12 of the present invention is easier to manufacture than conventional bolt assemblies. For example, conventional bolt assemblies require the firing pin through hole 54 to be bored through the entire length of the bolt carrier 16. In contrast, the firing pin through hole 54 of the bolt 14 of the present invention need only be bored through the bolt portion 14 and not through the rear portion 20 of the bolt carrier 16. The two-part bolt assembly 12 also allows for manufacture of a single bolt carrier 16 that can accommodate multiple calibers by choosing the correct bolt 14 for the desired caliber, in a modular fashion.

As shown in FIG. 7, on either side of the cup 26 is an extractor recess 78 configured to receive an extractor 80. The extractor 80 comprises a notch 82 to accept a cartridge rim, once it is fully in the cup 26. This allows the extractor 80 to extract a spent cartridge out of the chamber for ejection. The extractor 80 is able to rotate within the extractor recess 78. The extractor 80 has a chamfer 90 to push the extractor 80 out of the way when a cartridge is being pushed into cup 26. An extractor spring 84, inserted within an extractor spring recess 86 within the extractor recess 78, maintains pressure on the extractor 80 to maintain its grasp on the rim of a cartridge. The extractor 80 is biased against a tab 88 proximate the spring recess 86 to provide anti-rotation and keep the chamfer 90 in the correct orientation. When loading a cartridge into the cup 26, the rim of the cartridge engages the chamfer 90 on the extractor 80, thereby overcoming the extractor spring 84 to rotate the extractor 80 enough to accept the rim of the cartridge and then snap back again.

Another novel feature of a configurable blowback bolt system 10 of the present invention is that the cup 26 of the bolt 14 is configured to retain an extractor 80 on either side of the cup 26. The bolt 14 has two extractor recesses 78, as described above as regarding either side of the cup 26—one extractor recess 78 being on one side of the cup 26 and the second extractor recess 78 being on the other side of the cup 26. All of the features and configurations of the extractor recess 78 on one side, including the extractor spring recess 86 and the tab 88, are symmetrically configured on the opposing side of the cup 26. In this fashion, the cup 26 of the present invention is configured to retain an extractor 80, with its corresponding extractor spring 84 on either of the one side or the other. For example, the extractor 80 and extractor spring 84 may be inserted into the extractor recess 78 and spring recess 86, respectively, on one side of the cup 26, or the extractor 80 and extractor spring 84 may be inserted into the extractor recess 78 and spring recess 53 on the opposed side of the cup 26, interchangeably. The extractor 80 and extractor spring 84 may be moved from one side of the cup 26 to the other side of the cup 26 when the bolt 14 is disassembled from the bolt carrier 16, as described above. This interchangeability of the extractor 80 and extractor spring 84 enables the configurable blowback bolt system 10 to be used for ejection of spent cartridges either to the right side or to the left side of the firearm, interchangeably.

Accordingly, the bolt 14 further comprises a pair of longitudinal ejector grooves 92, as shown in FIGS. 1 and 4. each longitudinal ejector groove 92 thereof being disposed directly opposite one of the pair of extractor recesses 78, respectively, for accommodating a static ejector of the receiver of the firearm, either on the right side of the firearm or on the left side of the firearm, interchangeably. The static ejector of the receiver of the firearm is operationally received into the longitudinal ejector groove 92, either on the right side or on the left side, and slides in the ejector groove 92 to impact the rim of the spent cartridge at a point directly opposite the extractor 80 after the spent cartridge is extracted from the chamber. The impact of the static ejector on the rim, opposite the extractor 80, provides sudden counter-leverage to the spent cartridge that ejects the spent cartridge from the firearm, in the direction of the extractor 80 and opposite the static ejector. In accordance with the present invention, the bolt 14, having two longitudinal ejector grooves 92, one on each side, and two extractor recesses 78, one on each side, may be configured for ejecting spent cartridges either to the right side or to the left side of a firearm, interchangeably.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A two-part configurable bolt assembly, comprising:

a bolt carrier, the bolt carrier further comprising:

a rear portion; and a front portion, the front portion further comprising:

an opening for receiving a bolt therein; and a longitudinal slot through the top thereof;

an interchangeable bolt, coupled within the opening of the bolt carrier such that a longitudinal boss extending upward from the bolt extends upward through the longitudinal slot in the top of the bolt carrier, wherein the bolt is interchangeable with bolts of different configurations to accommodate pistol and rifle cartridges of different lengths and different calibers;

a lateral aperture through the bolt carrier;

a lateral aperture through the bolt, wherein the lateral aperture through the bolt is aligned with the lateral aperture through the bolt carrier;

a threaded aperture that extends downward through the longitudinal boss of the bolt and into the lateral aperture of the bolt, wherein the threaded aperture is offset slightly to the rear of the lateral aperture of the bolt;

a connecting pin inserted through the lateral aperture of the bolt carrier and through the lateral aperture of the bolt, the connecting pin having a radial groove around the center thereof; and a cone-point set screw threaded into the threaded aperture, the cone-point set screw engaging the connecting pin, thereby pressing the connecting pin and the bolt carrier forward while pressing the cone-point set screw and the bolt backward such that a forward-facing bearing surface of the bolt carrier is pressed tightly against a back surface of the bolt to secure the bolt to the bolt carrier.

2. The two-part configurable bolt assembly of claim 1, comprising:

a firing pin through hole disposed longitudinally through the bolt for receiving a firing pin therethrough, wherein the firing pin through hole does not extend through the rear portion of the bolt carrier.

3. The two-part configurable bolt assembly of claim 1, wherein a cup of the interchangeable bolt further comprises:

a first extractor recess, having a first extractor spring recess therein, on a first side of a cup of the bolt;

a second extractor recess, having a second extractor spring recess therein, on a second side of the cup;

a first ejector groove on a side of the bolt opposite the first extractor recess; and a second ejector groove on the side of the bolt opposite the second extractor recess, wherein the bolt is symmetrical with respect to a longitudinal vertical plane through the longitudinal axis thereof, wherein the bolt may be used to eject spent cartridges either to the right or to the left of a firearm by installing an extractor and extractor spring either into the first extractor recess and first extractor spring recess, respectively, or, into the second extractor recess and second extractor spring recess, respectively.

4. The two-part configurable bolt assembly of claim 1, further comprising:

a cub-point set screw threaded into the threaded aperture and tightened against the cone-point set screw to prevent the cone-point set screw from loosening.

5. The two-part configurable bolt assembly of claim 1, further comprising:

two lateral apertures through the bolt carrier;

two lateral apertures through the bolt, wherein each of the lateral apertures through the bolt is aligned with a lateral aperture through the bolt carrier, respectively;

two threaded apertures that extend downward through the longitudinal boss of the bolt, each threaded aperture extending into a lateral aperture of the bolt, respectively, wherein each threaded aperture is offset slightly to the rear of the corresponding lateral aperture of the bolt;

two connecting pins, each connecting pin being inserted through a lateral aperture of the bolt carrier and through the corresponding lateral aperture of the bolt, each connecting pin having a radial groove around the center thereof; and two cone-point set screws, each cone-point set screw being threaded into a threaded aperture, respectively, each cone-point set screw engaging a corresponding connecting pin, respectively, thereby pressing the connecting pin and the bolt carrier forward while pressing the cone-point set screw and the bolt backward such that a forward-facing bearing surface of the bolt carrier is pressed tightly against a back surface of the bolt to secure the bolt to the bolt carrier.

6. The two-part configurable bolt assembly of claim 5, further comprising:

two cub-point set screws, each cub-point set screw being threaded into a threaded aperture, respectively, and tightened against the corresponding cone-point set screw to prevent the cone-point set screw from loosening.

7. A configurable blowback bolt system for use within a firearm, comprising:

a two-part configurable bolt assembly, further comprising:

a bolt carrier, the bolt carrier further comprising:

a rear portion; and a front portion, the front portion further comprising:

an opening for receiving a bolt therein; and a longitudinal slot through the top thereof; and an interchangeable bolt, coupled within the opening of the bolt carrier such that a longitudinal boss extending upward from the bolt extends upward through the longitudinal slot in the top of the bolt carrier, wherein the bolt is interchangeable with bolts of different configurations to accommodate pistol and rifle cartridges of different lengths and different calibers;

an interchangeable buffer, the buffer being disposed directly behind the bolt carrier such that the bolt carrier impacts the buffer, thereby dissipating recoil forces through the buffer upon discharge of the firearm, wherein the buffer is interchangeable with buffers of different configurations to accommodate pistol and rifle cartridges of different lengths and different calibers;

a firing pin through hole disposed longitudinally through the bolt for receiving a firing pin therethrough, wherein the firing pin through hole does not extend through the rear Portion of the bolt carrier;

a lateral aperture through the bolt carrier;

a lateral aperture through the bolt, wherein the lateral aperture through the bolt is aligned with the lateral aperture through the bolt carrier;

a threaded aperture that extends downward through the longitudinal boss of the bolt and into the lateral aperture of the bolt, wherein the threaded aperture is offset slightly to the rear of the lateral aperture of the bolt;

a connecting pin inserted through the lateral aperture of the bolt carrier and through the lateral aperture of the bolt, the connecting pin having a radial groove around the center thereof; and a cone-point set screw threaded into the threaded aperture, the cone-point set screw engaging the connecting pin, thereby pressing the connecting pin and the bolt carrier forward while pressing the cone-point set screw and the bolt backward such that a forward-facing bearing surface of the bolt carrier is pressed tightly against a back surface of the bolt to secure the bolt to the bolt carrier.

8. The configurable blowback bolt system of claim 7, wherein a cup of the interchangeable bolt further comprises:

a first extractor recess, having a first extractor spring recess therein, on a first side of a cup of the bolt;

a second extractor recess, having a second extractor spring recess therein, on a second side of the cup;

a first ejector groove on a side of the bolt opposite the first extractor recess; and a second ejector groove on the side of the bolt opposite the second extractor recess, wherein the bolt is symmetrical with respect to a longitudinal vertical plane through the longitudinal axis thereof, wherein the bolt may be used to eject spent cartridges either to the right or to the left of a firearm by installing an extractor and extractor spring either into the first extractor recess and first extractor spring recess, respectively, or, into the second extractor recess and second extractor spring recess, respectively.

9. The configurable blowback bolt system of claim 7, further comprising:

a cub-point set screw threaded into the threaded aperture and tightened against the cone-point set screw to prevent the cone-point set screw from loosening.

10. The configurable blowback bolt system of claim 7, further comprising:

two lateral apertures through the bolt carrier;

two lateral apertures through the bolt, wherein each of the lateral apertures through the bolt is aligned with a lateral aperture through the bolt carrier, respectively;

two threaded apertures that extend downward through the longitudinal boss of the bolt, each threaded aperture extending into a lateral aperture of the bolt, respectively, wherein each threaded aperture is offset slightly to the rear of the corresponding lateral aperture of the bolt;

two connecting pins, each connecting pin being inserted through a lateral aperture of the bolt carrier and through the corresponding lateral aperture of the bolt, each connecting pin having a radial groove around the center thereof; and two cone-point set screws, each cone-point set screw being threaded into a threaded aperture, respectively, each cone-point set screw engaging a corresponding connecting pin, respectively, thereby pressing the connecting pin and the bolt carrier forward while pressing the cone-point set screw and the bolt backward such that a forward-facing bearing surface of the bolt carrier is pressed tightly against a back surface of the bolt to secure the bolt to the bolt carrier.

11. The configurable blowback bolt system of claim 10, further comprising:

two cub-point set screws, each cub-point set screw being threaded into a threaded aperture, respectively, and tightened against the corresponding cone-point set screw to prevent the cone-point set screw from loosening.

* * * * *